United States Patent [19]

Britz

[11] 4,281,440

[45] Aug. 4, 1981

[54] BELT BUCKLE CONSTRUCTION

[76] Inventor: Jeffrey E. Britz, 295 Fifth Ave., New York, N.Y. 10016

[21] Appl. No.: 123,533

[22] Filed: Feb. 22, 1980

[51] Int. Cl.[3] ..... A44B 11/00; A44B 11/12

[52] U.S. Cl. ..... 24/191; 24/163 FC; 24/170; 24/182

[58] Field of Search ..... 24/191, 182, 163 FC, 24/165 EC, 170, 74 R, 265 EC

[56] References Cited

U.S. PATENT DOCUMENTS

| | | | |
|---|---|---|---|
| 419,643 | 1/1890 | Crandal | 24/182 |
| 491,079 | 2/1893 | Coe | 24/191 |
| 1,312,670 | 8/1919 | Ballou | 24/74 R |
| 1,394,380 | 10/1921 | Wardner | 24/191 |
| 1,428,560 | 9/1922 | Robinson | 24/191 |
| 1,738,576 | 12/1929 | Hale | 24/191 |
| 1,775,137 | 9/1930 | Ostrower | 24/182 |
| 1,783,306 | 12/1930 | Otten | 24/191 |
| 2,807,849 | 10/1957 | Legat | 24/170 |
| 2,905,994 | 9/1959 | Krasnow et al. | 24/182 |
| 3,384,936 | 5/1968 | Sokoloff | 24/191 |

FOREIGN PATENT DOCUMENTS

| | | | |
|---|---|---|---|
| 664741 | 8/1938 | Fed. Rep. of Germany | 24/170 |
| 2549776 | 3/1977 | Fed. Rep. of Germany | 24/170 |
| 1027688 | 5/1953 | France | 24/74 R |
| 1160462 | 7/1958 | France | 24/265 EC |

*Primary Examiner*—Victor N. Sakran
*Attorney, Agent, or Firm*—Edwin E. Greigg

[57] ABSTRACT

Improved belt buckle construction adapted to receive a removable flexible belt loop and having material covering fixedly secured onto a belt buckle frame, the frame having raised sides on two opposite edges forming a recessed flat section for protecting a material covering wrapped around the buckle frame and extending between said opposite edges, extensions at one end of the belt buckle extending in opposite directions of the raised edges for forming a hinge element for engaging a flanged locking member disposed to have a claw grabbing surface for securing a belt strap end against the adjacent surface of the mating material covering, the flanged locking member having snap tabs at the free end thereof and for engaging snap formed tabs extending in an opposite direction of the raised sides located or positioned at the other end of the belt buckle from the hinged elements, and intermediate clamp elements for engaging a folded strap section in fixed relation to the belt frame.

7 Claims, 5 Drawing Figures

BELT BUCKLE CONSTRUCTION

CROSS REFERENCE TO PRIOR ART DISCLOSURES AND REFERENCES

There are no prior art disclosures and references that teach or show the present invention, but the following patents are of mere and cursory interest:

Ostrower—U.S. Pat. No. 1,775,137

Kransnow, et al.—U.S. Pat. No. 2,905,994

Sokoloff—U.S. Pat. No. 3,384,936

None of these known references considered singly or in combination show a covered recessed flat buckle member arranged for selectively receiving a flexible belt loop.

BRIEF SUMMARY OF THE INVENTION

The present invention relates to an improved belt buckle construction for receiving a removable flexible belt loop and a material covering the buckle member or frame being wrapped with the material covering secured thereon. More particularly the invention relates to a belt buckle apparatus on which there is a buckle frame having raised sides on two opposite edges forming a recessed flat section intermediate the raised sides and having extension at two corners projecting in the opposite direction from the raised sides, a covering of leather material adheringly wrapped and secured upon the recessed surface and extending in folded relation around and beneath an upper surface, a flanged shaped locking member pivotally mounted from the projecting extensions, snap formed tabs at the other end of the flanged member for engaging and mating with the snap tabs extending from the frame, and a removable flexible belt loop being received within a recess formed by the flanged locking member and the frame.

BACKGROUND OF THE INVENTION

There are patents and prior art devices showing and using a pivotal plate end of a belt strap when the pivotal plate is closed. Clamping structures are known to provide holding action with a belt buckle assembly. Pivotal plate elements are generally provided to grip an end of a belt and is often used to fixedly support a belt loop. None of these teach or suggest the advantages and features of the invention.

SUMMARY AND OBJECTS OF THE INVENTION

It is a feature and object of the present invention to provide a new and improved belt buckle construction of the class described in which there is reduced cost in fabrication and manufacture and yet provide a functionally and long-lasting device. A further object and advantage of the present invention provides for a buckle plate formed between two raised edges and upon which there is wrapped a leather material that augments and sufficiently increases the retention characteristics when a belt strap end is frictionally engaged for contact against the buckle covered frame.

A further object and advantage of the present invention is to provide means for adjusting the belt strap or in replacing the belt strap with other belt strap materials and yet maintain a good standard of frictional contact between the belt strap ends that are used with the belt strap frame, the increased frictional contact being based upon the use of the leather covering material wrapped around the buckle frame.

Another and additional object of the invention lies in the provision of providing a recess formed between raised edges so that the covering material of the buckle frame is moderately and efficiently protected from wear and mechanical deterioration resulting from contact with external objects.

BRIEF DESCRIPTION OF THE SEVERAL VIEWS OF THE DRAWING

These above objects and advantages together with other features as may appear will more fully be developed and disclosed in the following disclosure and specification and will be pointed out in the appended claims, together with the drawing to which reference will be made in the specification. The drawing includes the following several views:

DETAILED DESCRIPTION OF THE PREFERRED EMBODIMENT

Figure 1:
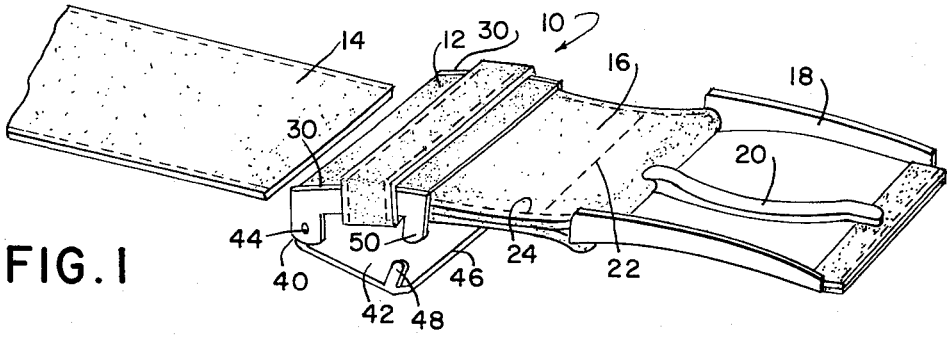
FIG. 1 is a perspective view of the belt buckle shown in assembled relation with a strap and buckle loop according to a preferred embodiment of the present invention.

Referring now to the drawings there is shown in accordance with a preferred embodiment of the invention a belt buckle apparatus 10 having a generally flat member or frame 12, a belt strap end 14 and a folded leather belt segment 16 receiving a buckle loop 18 and tongue element 20. The leather belt folded segment 16 is shown sewn along lines 22 and 24 of FIG. 1.

Figure 2:
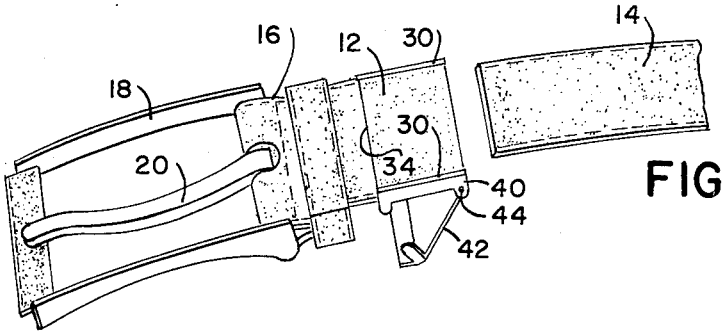
FIG. 2 shows an exploded perspective view of the buckle frame, an end of a belt strap and a leather belt folded segment having a belt buckle loop according to the invention.
Figure 5:
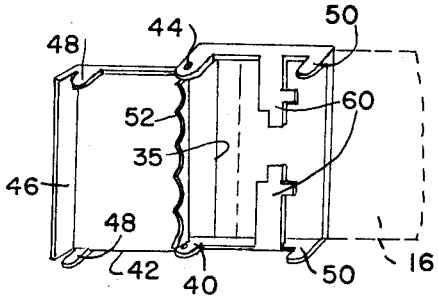
FIG. 5 shows a bottom view of the buckle frame with the flanged locking member in extended open position.
Figure 4:
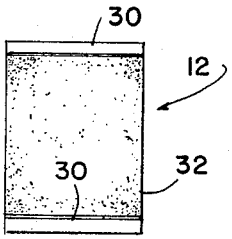
FIG. 4 shows a top view of the buckle frame member shown in FIG. 3.

The buckle frame member 12 is shown having raised sides 30, 30 on two opposite sides forming a recessed flat section 32 intermediate the raised sides 30, 30 for forming a flat section that receives a leathered simulated textured material 34 shown in FIGS. 2 and 4 which is adheringly wrapped and secured upon the upper surface and at least a portion of the lower surface terminating at an edge 36 shown in FIG. 5. This covering material 34 shown in its wrapped and folded relation around the buckle frame provides and enhances the buckle member with a resistive contact surface that provides improved adherence of a leather member or belt strap end 14 that is made in contact thereto as shall be described below. The raised edges provide protection and mechanical assurance that the edge and upper surface of the leather material 34 shall not be easily damaged, cut or excessively worn during ordinary use of a belt buckle apparatus 10.

The raised sides are provided at one end projections or extensions 40, 40 in an opposite direction from the raised edges and form a mating hinge element proximate the end thereof as shown in FIGS. 1 and 2 for receiving a flanged locking member 42 having a pivotally mounted extension 44 which is received in the hinged elements 40. The flanged locking member 42 has a flanged extension element 46 extending between snap formed tabs 48, 48 that are lockingly engaged with snap elements 50, 50 extending from the underside of the raised elements 30, 30. From the distal end 46 of the flanged locking member 42 there is a claw or grabbing surface 52 as shown in FIG. 5 of scalloped or claw type construction that is provided for engaging with a belt strap such as belt strap end 14.

Intermediate the extensions 40, 40 and the snap tabs 50, 50 there is a further projection or member shown as a clamp element 60, 60 shown in FIG. 5 to be folded over and firmly engaging a leather belt folded segment 16. Due to the wrapped leather covering material 34 that extends around the right hand edge of the frame 12 shown in FIG. 5 the material is seen to firmly engage with the folded segment 16 (not shown) and provides a resistive surface thereto so that the folded segment 16 increasingly adheres to the leather material covering 34 of the buckle frame 12.

The claw grabbing projections 52 securely lock a belt end 14 which is received in the recess formed between the buckle frame 12 and the flanged locking member 42.

Figure 3:
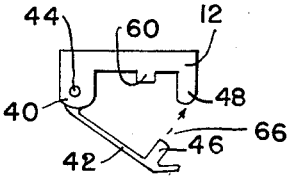
FIG. 3 is a side elevation view of the buckle frame member showing the pivotally mounted flanged locking member.

The snap tabs 50, 50 are contoured and bent to securely engage in a permanent locking relation with the snap elements 48, 48 in mating relation for thus holding the flanged locking member in the closed position when it is moved according to the arrow 66 shown in FIG. 3.

While only certain preferred embodiments of the invention have been shown and described, it is apparent that modifications, alterations and changes may be made without departing from the true scope and spirit thereof.

What is claimed and desired to be secured by Letters Patent of the United States is:

1. Improved belt buckle construction for receiving a removable flexible belt loop and material covering on a buckle frame comprising a generally flat frame having raised sides on two opposite edges for forming a recessed flat section intermediate the raised sides, said raised sides having extensions in an opposite direction forming mating hinge elements at an end thereof, a flanged locking member pivotally mounted onto said mating hinge elements adjacent a flange-formed portion thereof, a claw grabbing surface disposed between said mating hinge elements on said flanged locking member for engaging a belt strap end, snap formed tabs at the other end of said flanged locking member, said raised sides further having mating snap elements extending from the other end thereof and for lockingly engaging with said snap formed tabs, and clamp elements extending from intermediate portions of the raised sides adapted to be folded over and retain a leather member in fixed relation.

2. The invention according to claim 1 wherein a leather belt strap end is received in a recess formed between the hinge elements, the flat frame adjacent thereto and the claw grabbing projections of the flanged locking member.

3. The invention according to claim 1 wherein a removable flexible belt loop is receivably secured upon the frame and locked thereon by the flanged locking member.

4. The invention according to claim 1 wherein a leather belt folded segment receiving a buckle loop and tongue element has its mating free ends secured within said clamp element by the clamp element being folded upon the mating free ends.

5. The invention according to claim 1 wherein a covering of leather simulated textured material is adheringly wrapped and secured upon an upper surface of the flat frame throughout its recessed flat section and extending in folded relation around and beneath the upper surface, the extent of the covering material beneath the upper surface forming a resistive surface providing an improved adherence of a leather member thereto.

6. The invention according to claim 1 wherein said snap forming tabs and said mating snap elements are bent to securely snap in permanent relation for holding the flanged locking member closed.

7. The invention according to claim 4 wherein the leather belt folded segment is transversely stitched into closed relation.

* * * * *